US006526618B1

(12) United States Patent
Bolton

(10) Patent No.: US 6,526,618 B1
(45) Date of Patent: Mar. 4, 2003

(54) BATH SCRUBBER

(76) Inventor: John Bolton, 1512 Hillcrest Rd., Santa Barbara, CA (US) 91303

( * ) Notice: Subject to any disclaimer, the term of this patent is extended or adjusted under 35 U.S.C. 154(b) by 0 days.

(21) Appl. No.: 09/493,991

(22) Filed: Jan. 28, 2000

(51) Int. Cl.[7] ..... A47K 7/02

(52) U.S. Cl. ..... 15/160; 15/104.92; 15/210.1; 15/244.1; 4/606

(58) Field of Search ..... 15/104.92, 160, 15/210.1, 244.1; 4/606

(56) References Cited

U.S. PATENT DOCUMENTS

| | | | | |
|---|---|---|---|---|
| 585,086 | A | | 6/1897 | Cox |
| 621,920 | A | | 3/1899 | Johnson |
| 964,843 | A | | 7/1910 | Booth |
| 1,063,794 | A | | 6/1913 | Hess |
| 1,965,774 | A | | 7/1934 | Jaynes |
| 2,730,737 | A | | 1/1956 | Herman |
| 2,901,760 | A | | 9/1959 | Nelson |
| 3,040,337 | A | | 6/1962 | Fjelstad |
| 3,055,037 | A | * | 9/1962 | Fjelstad |
| 3,078,484 | A | | 2/1963 | Briggs |
| 3,209,372 | A | | 10/1965 | Boyett, Sr. et al. |
| 3,289,215 | A | | 12/1966 | Kennedy |
| 3,612,044 | A | | 10/1971 | Gurrola |
| 3,631,560 | A | | 1/1972 | Atkins |
| 3,750,226 | A | * | 8/1973 | Morgan |
| 4,003,372 | A | * | 1/1977 | Willoby |
| 4,020,519 | A | * | 5/1977 | Robinson |
| 4,417,362 | A | * | 11/1983 | Walker |
| 4,696,068 | A | * | 9/1987 | Kenner |
| 4,699,127 | A | * | 10/1987 | Schley |
| 5,175,896 | A | * | 1/1993 | Zamir |
| 5,179,755 | A | * | 1/1993 | Hill, Jr. |
| 5,403,642 | A | * | 4/1995 | Landi |
| 5,628,083 | A | * | 5/1997 | Hayes |
| 5,729,858 | A | * | 3/1998 | Riffel |
| 5,822,824 | A | * | 10/1998 | Dion |

FOREIGN PATENT DOCUMENTS

| | | | | |
|---|---|---|---|---|
| CH | 563146 | * | 6/1975 | ..... 15/210.1 |

* cited by examiner

*Primary Examiner*—Randall E. Chin
(74) *Attorney, Agent, or Firm*—Marvin E. Jacobs

(57) ABSTRACT

The bath scrubber includes an open resilient layer of loops of filaments of flexible, synthetic organic thermoplastic resin a rigid of flexible resin backing and releasable wall mounting means such as mini suction cups. The resin materials can contain antibacterial and antifungal agents.

11 Claims, 2 Drawing Sheets

BATH SCRUBBER

TECHNICAL FIELD

The present invention relates to a bath accessory, and, more particularly, this invention relates to a bath scrubber that can be used to scrub portions of the body not readily reachable by the hands of the bathers.

BACKGROUND OF THE INVENTION

Scrubbing of the skin during bathing or showering is beneficial to clean the skin, remove dead skin cells, clean the pores and to invigorate the skin and massage underlying muscles and tendons. A widely used natural material known as luffa sponge is used for scrubbing. A luffa sponge can not be used to scrub the back of the bather easily and luffa sponges tend to become fouled with organic skin debris containing bacteria. The luffa sponges are too soft to massage back or shoulder muscles.

Long handled brushes with stiff bristles or luffa sponges mounted in a base, are used for scrubbing the back of bathers. However, the scrubbing action is parallel to the back. It is difficult to apply to the brush or sponge a massaging force perpendicular to the back by manipulating the long handle. Maintaining the fouled bristles or sponge sanitary is again a problem. The ability to manipulate a long-handled scrubber decreases with diminished joint mobility which usually accompanies advancing age. Of course bathers missing hands or arms are not able to manipulate long handled scrubbers.

LIST OF PRIOR PATENTS

| PATENT | PATENTEE |
|---|---|
| 585,086 | Cox |
| 621,920 | Johnson |
| 964,843 | Booth |
| 1,063,794 | Hess |
| 1,965,774 | Jaynes |
| 2,730,737 | Herman |
| 2,901,760 | Nelson |
| 3,040,337 | Fjelstad |
| 3,078,484 | Briggs |
| 3,209,372 | Boyett, Sr. et al |
| 3,612,044 | Gurrola |
| 3,289,215 | Kennedy |
| 3,631,560 | Atkins |
| 3,750,226 | Morgan |
| 4,020,519 | Robison |
| 4,417,362 | Walker |

DISCUSSION OF PRIOR PATENTS

Suction cups to anchor a scrubbing device to a wall are shown by Morgan, Walker or Gurrola. The scrubber or massager can be washcloths, brush bristles, foam rubber or plastic fingers.

Gurrola discloses a back massage and scrub fixture in which a suction cup mounted frame supports a pad carrying protruding, resilient, conical fingers. Morgan discloses a suction cup mounted massaging device. The massaging front surface may be toweling tufts or foam rubber tufts 15 as shown in FIG. 5.

STATEMENTS OF THE INVENTION

The bath scrubber provided in accordance with the invention, can be used to readily scrub the formerly inaccessible surfaces of the body. The scrubber can be used to apply forces perpendicular to the surface of the body providing action which invigorates the skin and massages muscles, tendons and ligaments under the skin. The scrubber of the invention is not as subject to fouling by bacterial or fungal attack or organic material stuffed from the skin of the user.

The bath scrubber of the invention is formed of a layer of open mat of looped material formed of flexible, synthetic resin filaments attached to a stiff or flexible backing layer. The filaments and/or the backing layer can contain antibacterial and/or antifungal agents. Mounting means, such as suction cups or releasable Velcro straps, are provided on the rear surface of the backing for mounting the scrubber on the wall of a shower or bathtub enclosure. The mounting means are preferably a group of mini suction cups since a single large suction cup will not adhere to a tiled wall when the cup is placed over a grout line.

The bather need not use his/her hands to scrub his/her back. He/she first mounts the scrubber on a wall of a shower or tub enclosure. He/she then applies liquid or solid soap to the mat. He/she then moves backward until his/her back contacts the mat and then moves his/her back in a side to side motion while pressing his/her back against the mat. The loops abrade the skin of the back, removing dead skin cells and clean the pores. The pressure of the resilient loop filament layers invigorates the skin cleans and massages the back.

The scrubber can also be used to scrub the chest or other front portion of the bather. The scrubber is easily repositioned by releasing the suction cups or Velcro strips and repositioning the scrubber at a higher or lower location on the wall or tub. Also the scrubber can be removed from the wall to scrub any portion of body or limbs, feet, etc.

These and many other features and attending advantages of the invention will become apparent, as the invention becomes better understood by reference to the following detailed description when considered in conjunction with the accompanying drawings.

DETAILED DESCRIPTION OF THE INVENTION

Figure 6:
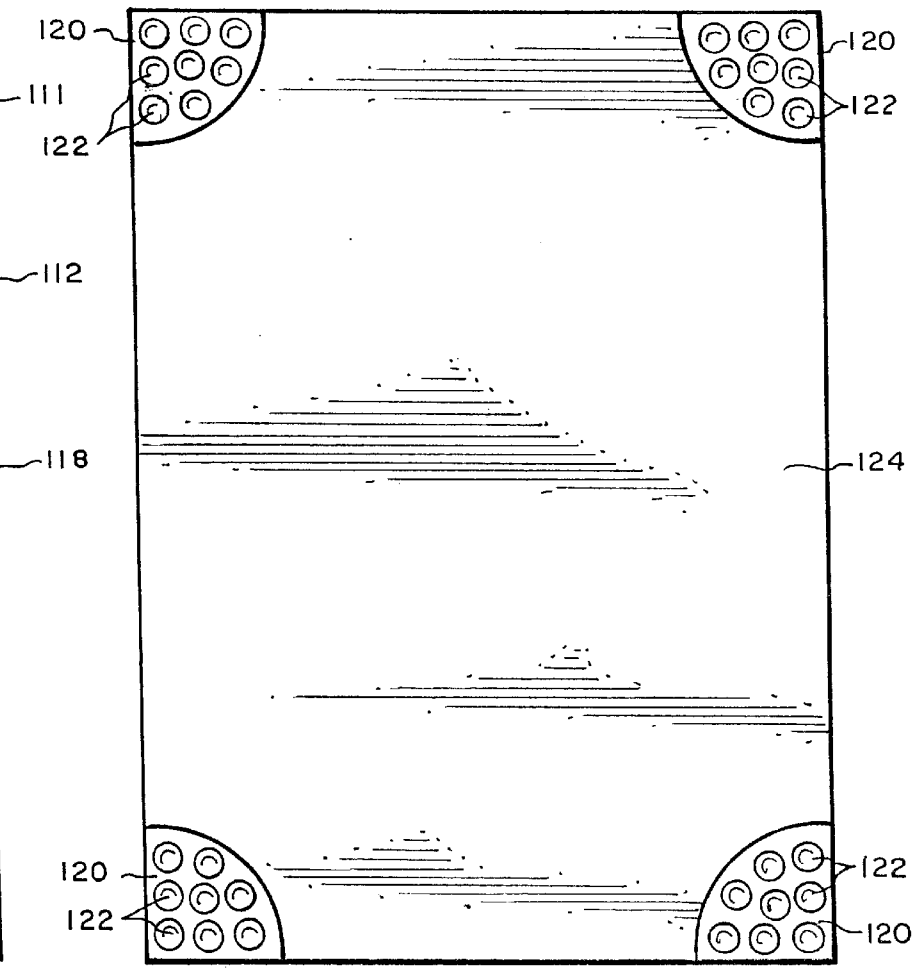
FIG. 6 is a rear view in elevation of the back scrubber of FIG. 1.

Referring now to FIGS. 1–4, the bath scrubber 10 of the invention comprises a soft, pliable, yieldable mat layer 12 of serpentine-looped, synthetic resin 14 filaments 13 mounted in a backing 18. The backing 18 can be rigid such as a panel of plastic or can be a flexible, impervious layer of resin. The loops 14 are flexible and can be arranged in side-by-side rows 30. The side-by-side loops 14 and rows 30 can overlap. The preferred scrubber, as shown in FIGS. 5 and 6, contains a non-woven mat formed of continuous filaments bonded together and embedded in a foam backing to form a durable resilient, water resistant scrubber. When forces normal to the mat are applied, the loops in a row and side-to-side overlap and fold and stack to provide a resilient cushion with the flattened loops providing the desired open, scrubbing action. On release of the pressure, the loops rebound to their original position. The scrubber is readily cleaned by flushing action of a shower head or faucet. The antibacterial and antifungal agents in the filaments and backing, resist fouling of the scrubber.

Figure 4:
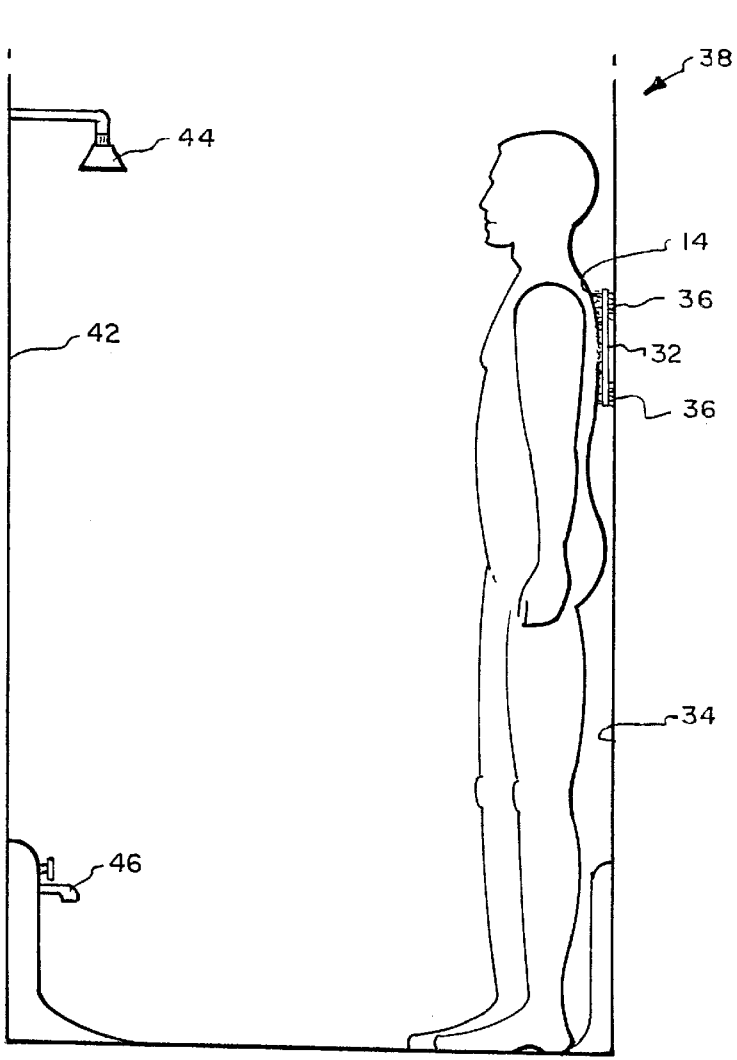
FIG. 4 is a schematic view in elevation showing the scrubber in use mounted on a wall of a bath enclosure or the end wall of a bathtub.
Figure 2:
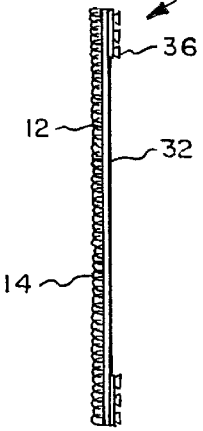
FIG. 2 is a side view in elevation of the bath scrubber shown in FIG. 1.
Figure 3:
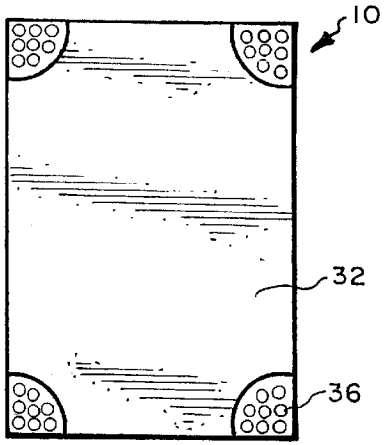
FIG. 3 is a rear view in elevation of the bath scrubber illustrated in FIG. 1.
Figure 1:
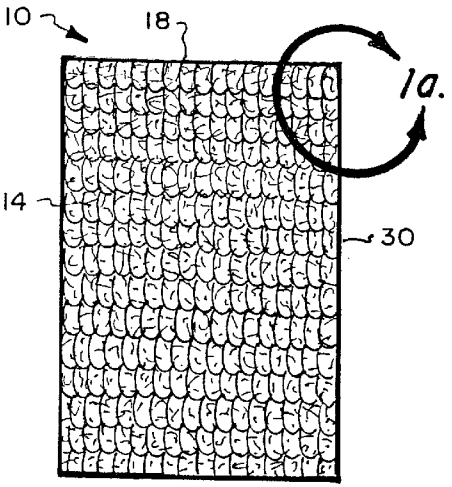
FIG. 1 is a front view in elevation of a bath scrubber in accordance with the invention.
Figure 1A:
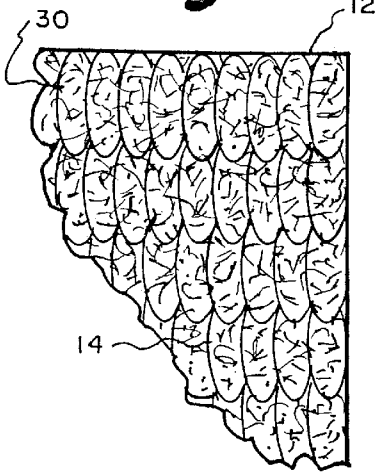
FIG. 1*a* is an enlarged detail of the mat layer of the bath scrubber illustrated in FIG. 1.
Figure 5:
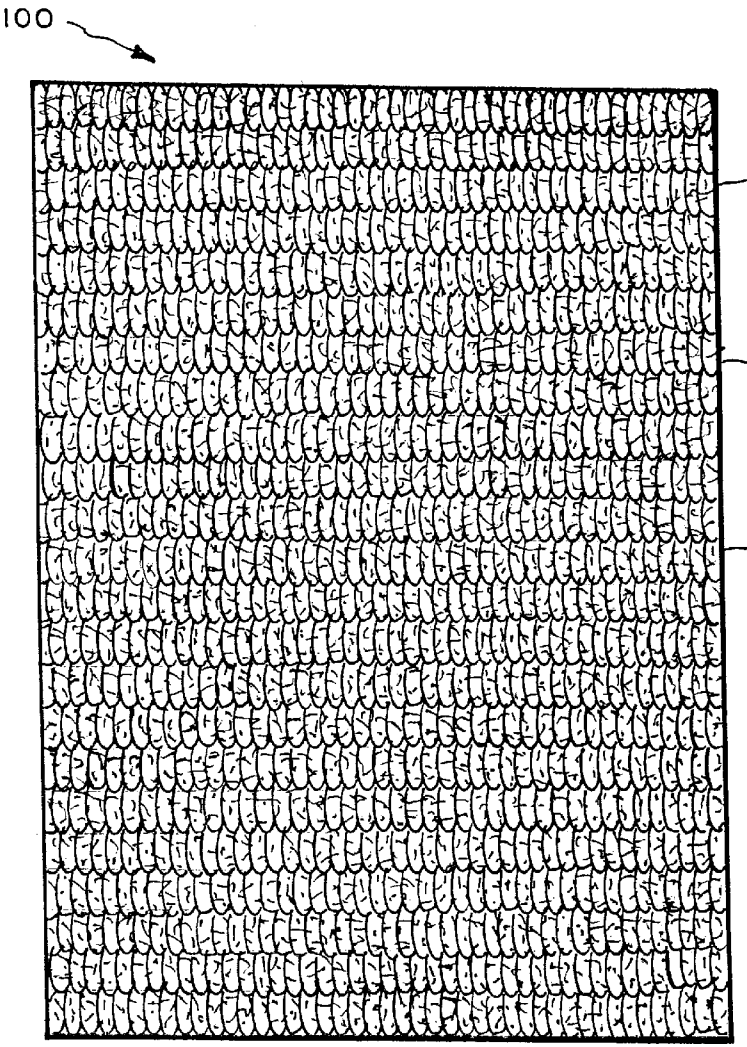
FIG. 5 is a front view in elevation of a preferred back scrubber.

Referring now to FIG. 4, devices such as suction cups 36 for releasably adhering the scrubber to smooth painted or tiled wall surfaces 34 are mounted on the rear surface 32 of the backing 18. The mounting device can be a strip of hook-loop material such as Velcro which would adhere to a mating Velcro strip adhered to the wall 34 of the enclosure. Suction cups 36 are preferred since they can readily be reattached to the smooth, wet wall surfaces 34 in a bath enclosure or tub 38. The scrubber 10 is preferably mounted on the wall 34 opposite the wall 42 containing a shower head 44 or bath faucet 46.

Referring now to FIGS. 5 and 6 a preferred bath scrubber 100 contains a resilient, open mat layer 112 formed of non-woven continuous filaments 111 which bond together. The mat can be formed by applying a stream of air to molten filaments as they are extruded.

The filaments are preferably formed of vinyl resins. The mat layer can have a thickness of about ¼ inch, a length of about 12 inches and a width of about 8 inches. The mat layer 112 is attached to an integral, fused, foam backing, 118 also preferably formed of vinyl resin. The thickness of the backing is suitably about ⅛ inch.

Standard elastomeric suction cups having a diameter of about ½ to 2 inches are satisfactory for use on smooth walls such as fiberglass, reinforced polyester, vinyl, acrylic or ceramic shower or tub wall surfaces. However, in walls tiled with discrete tile pieces such as squares, rectangles, hexagons etc. the spaces between tiles containing grout are relieved and cannot seal with suction cups. Referring now to FIG. 6, in accordance with a preferred aspect of the invention, the mounting means provided at the corners of the back surface 120 of the scrubber 100 contain a plurability of individual, small suction cups 122. The small suction cups 122 can be mounted on a sheet 124 secured the surface 120 by adhesive or other suitable adhesive means such as thermal bonding, ultrasonic bonding etc. The small suction cups 122 are present in groups of at least 3 up to as many as desired. The diameter of the mini suction cups 122 is suitably from 1/16 to ½ inch, usually about ⅛ to ¼ inch.

The scrubber can readily be manufactured from non-woven continuous or discontinuous lengths of filaments of organic resins, preferably hydrocarbon resins such as vinyl, polyethylene or polypropylene resins. The discontinuous filaments can be bent into loops and embedded in a resin backing. The filaments can be bonded together into a mat layer and bonded to or embedded in a resilient backing such as closed wall foam formed of the same resin. Thermoplastic resins such as vinyl can be thermobonded. The resins can be compounded with antibacterial and antifungal agents.

The mat can be made from material similar to that used as door mats or floor mats. The material is cut into mats from 6–8 inches wide by 10–12 inches long. Suction cups, suitable made of polyurethane are embedded in the backing and/or adhesively secured to the backing of the mat. The weight basis of a scrubber mat formed of resin filaments is suitably 1–10 pounds per square yard; generally around 5.5 pounds per square yard. The thickness of the mat is usually from 0.2 to 1.0 inch, usually about ½ inch.

Mats formed from vinyl resin can be compounded to have antibacterial and antifungal properties. They have excellent resistance to water and to soaps and detergents. They can be readily provided in colors by adding dye to the vinyl resins before spinning the filaments. The backing can be formed by immersing a portion of the loops in liquid vinyl resin and hardening and curing the liquid to form a rigid or resilient backing. The scrubber need not be rectangular. It can be prorated in other polygonal shapes or in irregular shapes manufactured.

The bath scrubber is used as follows:

1. Wet suction cups and stick on shower wall at chest height; or at end wall of bathtub.
2. Wet scrubber and lather with soap.
3. Rub back on scrubber.
4. Leave scrubber in position and rinse with clear water. The scrubber will not mildew.

It is to be realized that only preferred embodiments of the invention have been described and that numerous substitutions, modifications and alterations are permissible without departing from the spirit and scope of the invention as defined in the following claims.

What is claimed is:

1. A bath scrubber for mounting on a tiled wall comprising in combination:

a soft, pliable resilient, compressible, non-woven mat layer formed of flexible, thermoplastic, synthetic, resin filaments formed into side-by-side rows of open loops bonded together, said loops and rows overlapping, and said mat having an outer surface and an inner surface; and the inner surface of the mat being embedded in a first surface of a layer of foam backing; and a plurality of mini-suction cups attached to a second surface of the foam backing, the diameter of the suction cups being less than ½ inch; and whereby when forces normal to the mat are applied to the mat, the loops in a row and loops in adjacent rows fold and stack to provide a resilient cushion with the overlapped loops providing an open scrubbing action and on release of the normal pressure, the loops rebound to their original pattern.

2. A bath scrubber according to claim 1 in which the filaments contain antimicrobial agents.

3. A bath scrubber according to claim 1 in which the suction cups are formed of a synthetic resin.

4. A bath scrubber according to claim 1 in which the mat layer is formed of a hydrocarbon, thermoplastic resin.

5. A bath scrubber according to claim 4 in which the resin is selected from the group consisting of vinyl, polyethylene and polypropylene resins.

6. A bath scrubber according to claim 1 in which the backing comprises a closed cell foam.

7. A bath scrubber according to claim 6 having a first dimension from about 3–6 inches and a second dimension from about 5–9 inches and a thickness from about 0.2 to 1.0 inches.

8. A bath scrubber according to claim 1 in which the tile wall has spaced grout lines and the mini-suction cups have a diameter from 1/16 to ½ inch.

9. A bath scrubber according to claim 8 in which the mini-suction cups have a diameter from ⅛ to ¼ inch.

10. A bath scrubber according to claim 8 in which the mat is in the form of a polygon having corners and wherein the mini-suction cups are present only in the corners in groups of at least 3 mini-suction cups.

11. A bath scrubber according to claim 1 in which the mat is formed by applying a stream of air to molten filaments which adhere to each other to form said mat.

* * * * *